US008419387B1

(12) United States Patent
Karbs et al.

(10) Patent No.: US 8,419,387 B1
(45) Date of Patent: Apr. 16, 2013

(54) BAG SEAL MOUNTING PLATE WITH BREATHER TUBE

(75) Inventors: Randy Karbs, Edmond, OK (US); Michael Barnes, Yukon, OK (US); Alan Howell, Oklahoma City, OK (US); Arcady Royzen, Norman, OK (US)

(73) Assignee: GE Oil & Gas ESP, Inc.

( * ) Notice: Subject to any disclaimer, the term of this patent is extended or adjusted under 35 U.S.C. 154(b) by 807 days.

(21) Appl. No.: 12/491,985

(22) Filed: Jun. 25, 2009

Related U.S. Application Data

(60) Provisional application No. 61/194,138, filed on Sep. 25, 2008.

(51) Int. Cl.
*F04B 17/00* (2006.01)
*F04B 35/04* (2006.01)

(52) U.S. Cl.
USPC ..... 417/414

(58) Field of Classification Search ..... 417/423.3, 417/423.11, 423.14, 414; 310/87; 166/68, 166/105, 105.1, 105.5, 106, 107, 187; 277/322, 277/366
See application file for complete search history.

(56) References Cited

U.S. PATENT DOCUMENTS

| | | | | |
|---|---|---|---|---|
| 3,475,634 | A * | 10/1969 | Pomezkova | 310/87 |
| 4,940,911 | A * | 7/1990 | Wilson | 310/87 |
| 5,622,222 | A * | 4/1997 | Wilson et al. | 166/105.4 |
| 6,046,521 | A * | 4/2000 | Heinig | 310/87 |
| 6,100,616 | A * | 8/2000 | Heinig et al. | 310/87 |
| 6,268,672 | B1 * | 7/2001 | Straub et al. | 310/87 |
| 6,602,059 | B1 * | 8/2003 | Howell et al. | 417/423.3 |
| 6,666,664 | B2 * | 12/2003 | Gross | 417/423.3 |
| 7,066,248 | B2 * | 6/2006 | Howell | 166/105.5 |
| 7,182,584 | B2 * | 2/2007 | Du et al. | 417/414 |
| 7,367,400 | B1 * | 5/2008 | Howell | 166/310 |
| 7,530,391 | B2 * | 5/2009 | Hall et al. | 166/105 |
| 7,665,975 | B2 * | 2/2010 | Parmeter et al. | 417/423.11 |

* cited by examiner

*Primary Examiner* — Devon Kramer
*Assistant Examiner* — Amene Bayou
(74) *Attorney, Agent, or Firm* — Crowe & Dunlevy

(57) ABSTRACT

A submersible pumping system includes a pump assembly, a motor and a seal section positioned between the pump assembly and the motor. The seal section includes a clean fluid circulation system, a contaminated fluid circulation system and at least one bag seal assembly. The bag seal assembly includes an upper mounting block, a lower mounting block and a bag seal extending over the upper mounting block and lower mounting block and providing a path for the clean fluid circulation system. The bag seal assembly further includes a mounting plate connected to the upper mounting block that limits the axial travel of the bag seal on the upper mounting block. The bag seal assembly optionally includes a breather tube connected to the mounting plate and extending along the exterior of the bag seal.

11 Claims, 3 Drawing Sheets

BAG SEAL MOUNTING PLATE WITH BREATHER TUBE

RELATED APPLICATIONS

This application claims priority to U.S. Provisional Patent Application No. 61/194,138, entitled Seal Breather Plate for Bag Type Seals, filed Sep. 25, 2008, the disclosure of which is incorporated herein.

FIELD OF THE INVENTION

This invention relates generally to the field of submersible pumping systems, and more particularly, but not by way of limitation, to a seal section separation bag for use with a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Each of the components and sub-components in a submersible pumping system is engineered to withstand the inhospitable downhole environment, which includes wide ranges of temperature, pressure and corrosive well fluids.

Components commonly referred to as "seal sections" protect the electric motors and are typically positioned between the motor and the pump. In this position, the seal section provides several functions, including transmitting torque between the motor and pump, restricting the flow of wellbore fluids into the motor, protecting the motor from axial thrust imparted by the pump, and accommodating the expansion and contraction of motor lubricant as the motor moves through thermal cycles during operation. Many seal sections employ seal bags to accommodate the volumetric changes and movement of fluid in the seal section. Seal bags can also be configured to provide a positive barrier between clean lubricant and contaminated wellbore fluid.

In the past, seal bags have been constructed by sliding an open-ended bag over cylindrical mounting blocks. Hose clamps are used to secure the ends of the bag to the mounting blocks. Although generally acceptable, prior art bag mounting mechanisms suffer from several deficiencies. First, as the pressure inside the elastomer bag increases, the ends of the bag may axially slide over the mounting blocks, thereby allowing the bag to over-inflate. If the bag significantly over-inflates, the bag may rupture and the integrity of the seal section may be compromised.

Second, as the bag inflates during normal operation, the bag radially expands within a cavity in the seal section. The expansion of the bag may prevent proper fluid communication through the cavity around the exterior of the elastomer bag. There is therefore a need for an improved seal bag, seal sections and submersible pumping systems that overcome the deficiencies of the prior art. It is to this and other needs that the present invention is directed.

SUMMARY OF THE INVENTION

In a presently preferred embodiment, a seal section for use in a downhole submersible pumping system includes a clean fluid circulation system, a contaminated fluid circulation system and at least one bag seal assembly. The bag seal assembly includes an upper mounting block, a lower mounting block and a bag seal extending over the upper mounting block and lower mounting block and providing a path for the clean fluid circulation system. The bag seal assembly further includes a mounting plate connected to the upper mounting block that limits the axial travel of the bag seal on the upper mounting block. In another embodiment, the bag seal assembly preferably includes a breather tube connected to the mounting plate and extending along the exterior of the bag seal. The breather tube forms part of the contaminated fluid circulation system.

DETAILED DESCRIPTION OF THE PREFERRED EMBODIMENTS

Figure 1:
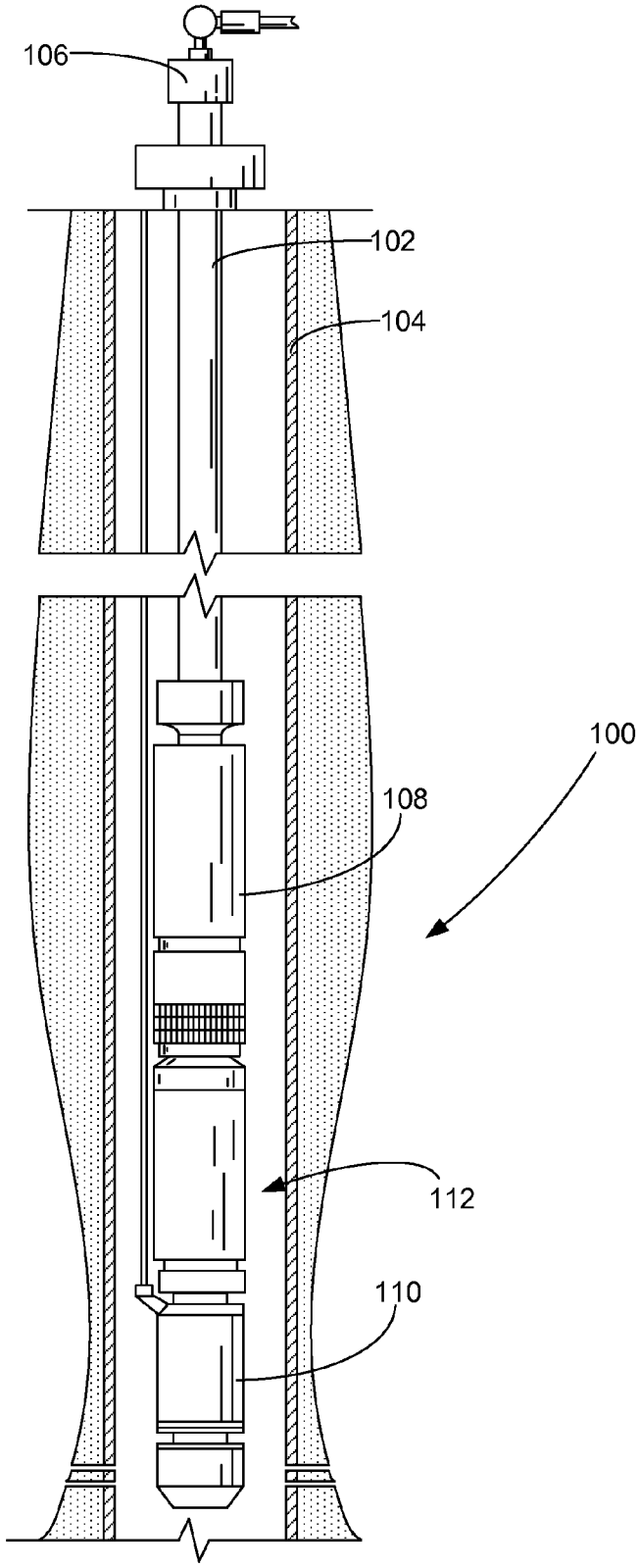
FIG. 1 is an elevational view of a submersible pumping system constructed in accordance with a presently preferred embodiment.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The pumping system 100 preferably includes some combination of a pump assembly 108, a motor assembly 110 and a seal section 112. The motor assembly 110 is preferably an electrical motor that receives power from a surface-mounted motor control unit (not shown). When energized, the motor assembly 110 drives a shaft that causes the pump assembly 108 to operate. The seal section 112 shields the motor assembly 110 from mechanical thrust produced by the pump assembly 108 and provides for the expansion of motor lubricants during operation. The seal section 112 also isolates the motor assembly 110 from the wellbore fluids passing through the pump assembly 108. Although only one of each component is shown, it will be understood that more can be connected when appropriate. It may be desirable to use tandem-motor combinations, multiple seal sections, multiple pump assemblies or other downhole components not shown in FIG. 1.

Figure 2:
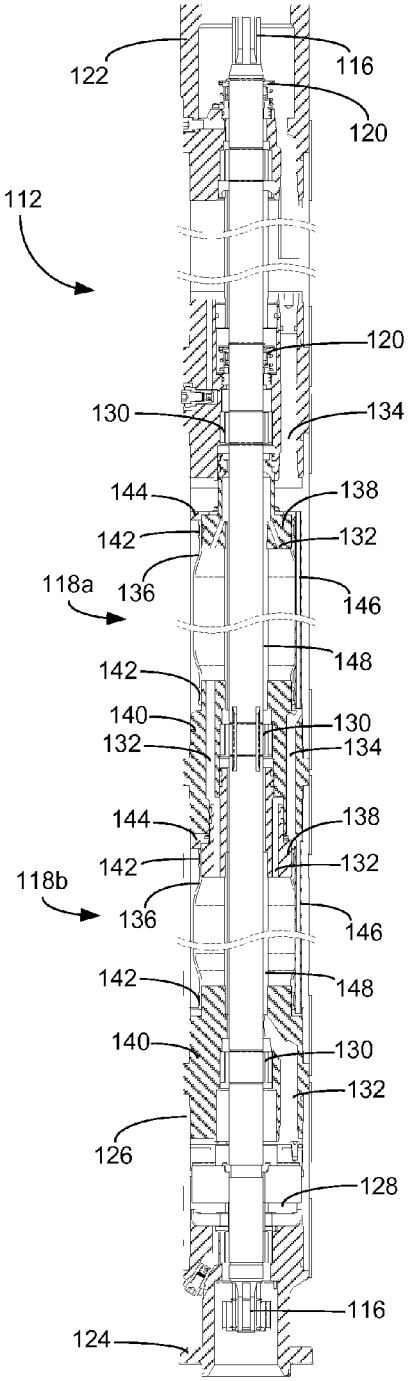
FIG. 2 is a cross-sectional view of a first preferred embodiment of a seal section for use with the submersible pumping system of FIG. 1.

Referring now to FIG. 2, shown therein is a cross-sectional view of the seal section 112. The seal section 112 includes a housing 126, a shaft 116, a first seal bag assembly **118*a* and a second seal bag assembly 118*b* (collectively "seal bag assemblies 118"). The shaft 116 transfers mechanical energy from the motor assembly 110 to the pump assembly 108**.

The seal section 112 further includes a plurality of mechanical seals 120, a head 122 configured for connection to the pump assembly 108 (not shown in FIG. 2), a base 124 configured for connection to the motor assembly 110 (not shown in FIG. 2) and a housing 126 configured to protect the internal components of the seal section 112 from the exterior wellbore environment. The head 122 and base 124 are preferably configured for a locking threaded engagement with the housing 126. The mechanical seals 120 are positioned along the shaft 116 and limit the migration of fluid along the shaft 116.

The seal section 112 further includes thrust bearings 128 and a plurality of support bearings 130. Thrust bearings 128 are used to control the axial displacement of the shaft 116. Support bearings 130 control the lateral position of the shaft 116. In the presently preferred embodiments, the thrust bearings 128 and support bearings 130 are configured as hydrodynamic bearings and constructed using industry-recognized bearing materials.

The seal section 112 includes a series of ports, channels, chambers and tubes that permit the movement of fluids through the seal section 112. A clean fluid circulation system 132 accommodates the expansion and movement of clean motor lubricant through the seal section 112. A contaminated fluid circulation system 134 accommodates the movement of potentially contaminated wellbore fluids through the seal section 112. The contaminated fluid circulation system 134 passes fluid along the exterior of the bag assemblies 118, while the clean fluid circulation system 132 passes fluid through the interior of the bag assemblies 118.

Figure 3:
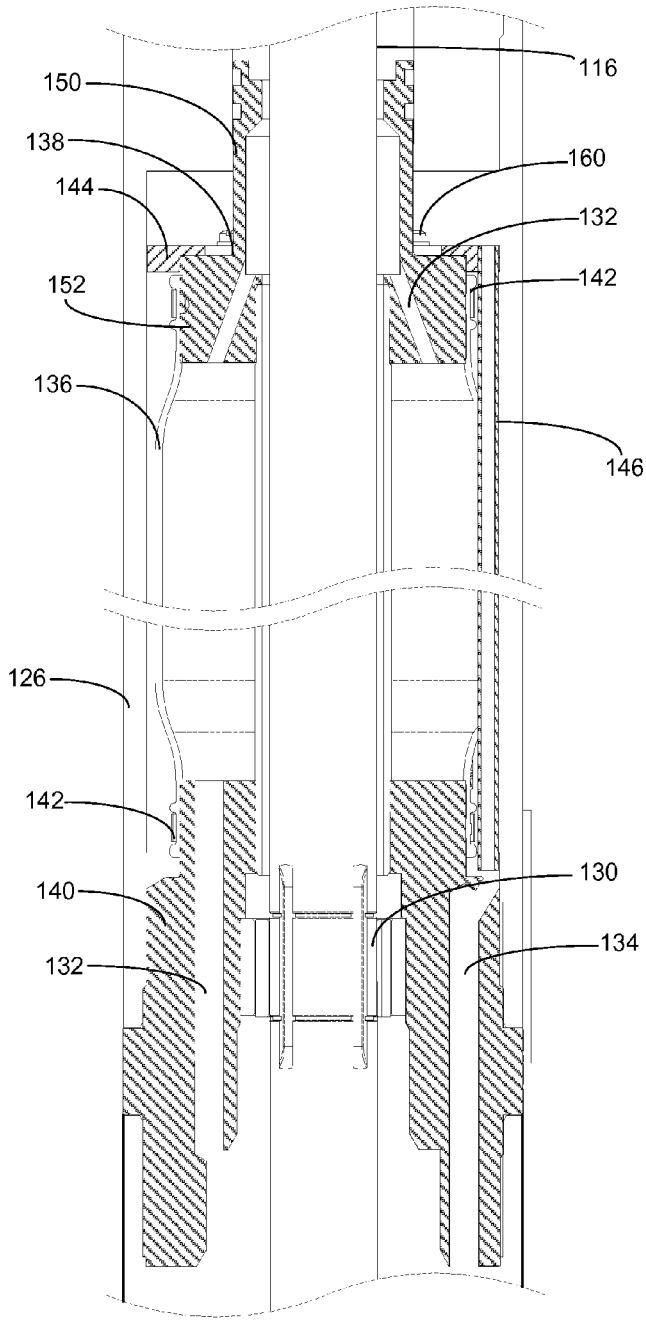
FIG. 3 is a close-up cross-sectional view of the seal bag assembly of the seal section of FIG. 2.
Figure 4:
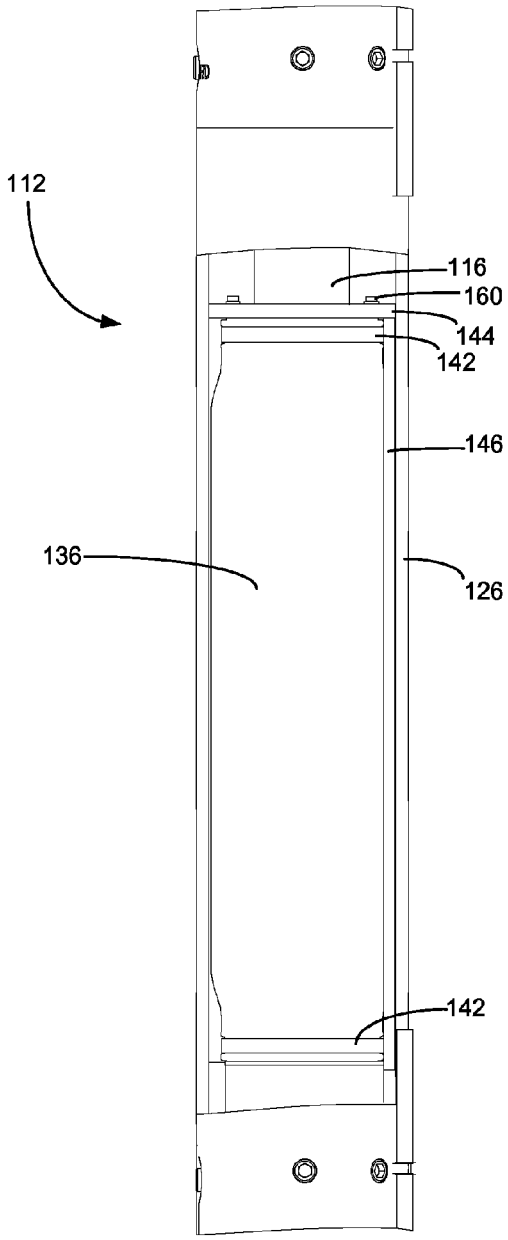
FIG. 4 is a partial cut-away view of the seal bag assembly of FIG. 2.

Turning to FIGS. 3 and 4, the seal bag assemblies 118 each are configured to prevent the contamination of clean motor lubricants with wellbore fluids. Each bag assembly 118 includes a seal bag 136, an upper mounting block 138, a lower mounting block 140, a plurality of bag clamps 142, a mounting plate 144, a breather tube 146 and a shaft support sleeve 148. For purposes of illustration, the bag seal assemblies 118 are disclosed as contained within the seal section 112. It will be understood, however, that the bag seal assemblies 118 could be installed elsewhere in the pumping system 100. For example, it may be desirable to integrate a bag seal assembly 118 within the motor assembly 110 or pump assembly 108. Furthermore, although two bag seal assemblies 118 are shown in FIG. 2, it will be understood that fewer or additional bag seal assemblies 118 may also be employed.

In the preferred embodiment, each seal bag 136 is fabricated with a material that is resistant to degradation from exposure to wellbore substances. Each seal bag 136 is secured to the upper and lower mounting blocks 138, 140 with bag clamps 142. The bag clamps 142 are preferably configured as tension-type locking clasps or worm-gear adjustable clamps. The shaft shielding tube 148 extends through the seal bag 136 between the upper and lower mounting blocks 138, 140 and shields the shaft 116 as it passes through the seal bag 136. The upper mounting blocks 138 each include a neck 150 and a base 152. Passages in the base 152 of the upper mounting blocks 138 are part of the clean fluid circulation system 132. The ends of the seal bag 136 are preferably sized to closely fit over the outer diameter of the base 152 of the upper mounting block 138 and the lower mounting block 140.

Figure 5:
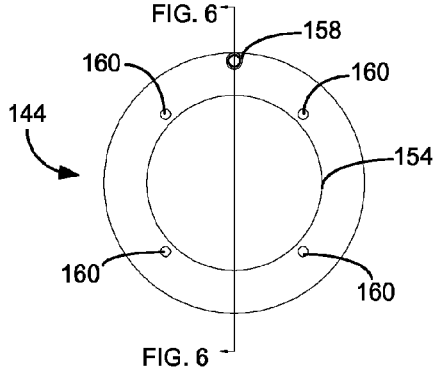
FIG. 5 is top plan view of the mounting plate of the seal bag assembly of FIG. 2.
Figure 6:
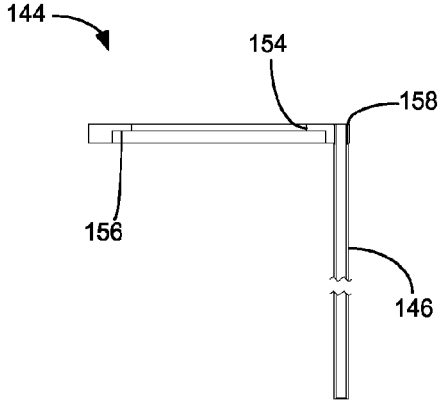
FIG. 6 is a side cross-sectional view of the mounting plate of FIG. 5.

Referring now also to FIGS. 5 and 6, the mounting plate 144 is preferably configured as a circular flange with a central opening 154, an interior shoulder 156, a breather tube port 158 and a plurality of fasteners 160. The central opening 154 is sized and configured to permit the placement of the mounting plate 144 over the neck 150 of the upper mounting block 138. The interior shoulder 156 of the mounting plate 144 is sized and configured to rest on top of and extend around the outer diameter of the base 152 of the upper mounting block 138. Fasteners 160 secure the mounting plate 144 to the base 152 of the upper mounting block 138. In a presently preferred embodiment, fasteners 160 are screws. When installed on the upper mounting block 138, the mounting plate 144 acts as a stop that prevents the bag seal 136 from axially distending beyond an acceptable extent. In this way, the mounting plate 144 prevents the bag seal 136 from over-inflating.

The mounting plate also provides a protected path for the contaminated fluid circulation system 134. The breather tube 146 extends along the exterior of the bag seal 146 from the mounting plate 144 to the lower mounting block 140. In a presently preferred embodiment, the breather tube 146 and breather tube port 158 are configured for a slip fit and solder engagement. The breather tube 146 is preferably configured as an elongated cylinder and manufactured from a rigid material that is resistant to wellbore fluids and elevated temperatures, such as steel. The breather tube 146 and mounting plate 144 work together to provide a protected fluid path for the contaminated fluid circulation system 134 along the outside of the bag seal 136. Even when the bag seal 136 is inflated to its maximum extent and expands into contact with the breather tube 146, the breather tube 146 does not collapse and provides a constant, unblocked fluid path for the contaminated fluid circulation system 132.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A seal section for use in a downhole submersible pumping system, the seal section comprising:

a clean fluid circulation system;

a contaminated fluid circulation system; and at least one bag seal assembly, wherein the bag seal assembly comprises:

an upper mounting block, wherein the upper mounting block comprises:

a base; and a neck extending from the base;

a lower mounting block;

a bag seal extending over the upper mounting block and lower mounting block, wherein an interior of the bag seal provides a path for the clean fluid circulation system;

a breather tube that extends between the upper and lower mounting blocks and forms part of the contaminated fluid circulation system; and a mounting plate connected to the upper mounting block, wherein the mounting plate limits an axial travel of the bag seal on the upper mounting block, and wherein the mounting plate comprises:

a central opening sized and configured to permit installation of the mounting plate over the neck of the upper mounting block;

an interior shoulder sized and configured to rest on top of and around an outer diameter of the base of the upper mounting block; and a breather tube port, wherein the breather tube port is configured for threaded engagement with the breather tube.

2. The seal section of claim 1, wherein the bag seal is secured to the upper and lower mounting blocks with clamps.

3. The seal section of claim 1, wherein the upper and lower mounting blocks include fluid passages that form part of the clean fluid circulation system.

4. The seal section of claim 1, wherein the mounting plate is secured to the upper mounting block with fasteners.

5. The seal section of claim 1, wherein the breather tube is connected to the mounting plate.

6. A bag seal assembly comprising:

an upper mounting block, wherein the upper mounting block comprises:

a base; and a neck extending from the base;

a lower mounting block;

a bag seal extending over the upper mounting block and lower mounting block;

a breather tube that extends between the upper and lower mounting blocks; and a mounting plate connected to the upper mounting block, wherein the mounting plate limits an axial travel of the bag seal on the upper mounting block and wherein the mounting plate comprises:

a central opening sized and configured to permit installation of the mounting plate over the neck of the upper mounting block;

an interior shoulder sized and configured to rest on top of and around an outer diameter of the base of the upper mounting block; and a breather tube port, wherein the breather tube port is configured for slip fit and solder engagement with the breather tube.

7. The bag seal assembly of claim 6, wherein the bag seal is secured to the upper and lower mounting blocks with clamps.

8. The bag seal assembly of claim 6, wherein the mounting plate is secured to the upper mounting block with fasteners.

9. The bag seal assembly of claim 6, wherein the breather tube is connected to the mounting plate.

10. A submersible pumping system comprising:

a pump assembly;

a motor assembly configured to drive the pump assembly; and a seal section positioned between the pump assembly and the motor assembly, wherein the seal section comprises:

a clean fluid circulation system;

a contaminated fluid circulation system; and at least one bag seal assembly, wherein the bag seal assembly comprises:

an upper mounting block, wherein the upper mounting block comprises:

a plurality of fluid paths that form part of the clean fluid circulation system;

a base; and a neck extending from the base;

a lower mounting block;

a bag seal extending over the upper mounting block and lower mounting block, wherein an interior of the bag seal provides a path for the clean fluid circulation system;

a breather tube extending between the upper and lower mounting blocks and forming part of the contaminated fluid circulation system; and a mounting plate connected to the upper mounting block, wherein the mounting plate limits an axial travel of the bag seal on the upper mounting block, wherein the mounting plate comprises:

a central opening sized and configured to permit installation of the mounting plate over the neck of the upper mounting block;

an interior shoulder sized and configured to rest on top of and around an outer diameter of the base of the upper mounting block; and a breather tube port, wherein the breather tube port is configured for threaded engagement with the breather tube.

11. The submersible pumping system of claim 10, wherein the upper and lower mounting blocks include fluid passages that form part of the clean fluid circulation system.

* * * * *